US008991496B2

(12) United States Patent
Bishop

(10) Patent No.: US 8,991,496 B2
(45) Date of Patent: Mar. 31, 2015

(54) FIRING HEAD ACTUATOR FOR A WELL PERFORATING SYSTEM AND METHOD FOR USE OF SAME

(71) Applicant: Halliburton Energy Services, Inc., Houston, TX (US)

(72) Inventor: Trevor Ross Bishop, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/170,607

(22) Filed: Feb. 1, 2014

(65) Prior Publication Data

US 2014/0318766 A1 Oct. 30, 2014

(51) Int. Cl.
*E21B 29/00* (2006.01)
*E21B 43/1185* (2006.01)

(52) U.S. Cl.
CPC ..... *E21B 29/00* (2013.01); *E21B 43/11852* (2013.01)
USPC ..... 166/298

(58) Field of Classification Search
CPC ..... E21B 43/1185; E21B 43/11852
See application file for complete search history.

(56) References Cited

U.S. PATENT DOCUMENTS

| | | | |
|---|---|---|---|
| 4,572,288 | A | 2/1986 | Kinley |
| 4,911,251 | A | 3/1990 | George et al. |
| 5,062,485 | A | 11/1991 | Wesson et al. |
| 5,301,755 | A | 4/1994 | George et al. |
| 5,490,563 | A | 2/1996 | Wesson et al. |
| 5,912,428 | A | 6/1999 | Patti |
| 8,002,026 | B2 | 8/2011 | Arrell, Jr. et al. |
| 8,322,426 | B2 | 12/2012 | Wright et al. |

FOREIGN PATENT DOCUMENTS

| | | |
|---|---|---|
| EP | 0713954 | 5/1996 |

OTHER PUBLICATIONS

International Search Report and Written Opinion, KIPO, PCT/US2013/036528, Jan. 7, 2014.

*Primary Examiner* — David Andrews

(57) ABSTRACT

A firing head actuator for a well perforating system. The firing head actuator includes a housing assembly with a first impact piston initially secured thereto and slidably disposed therein. An electronic time delay assembly, a trigger assembly and an initiator are also disposed within the housing assembly. A second impact piston is initially secured within and slidably disposed within the housing assembly. In operation, a pressure signal of a predetermined threshold actuates the first impact piston, the first impact piston mechanically actuates the electronic time delay assembly, after a predetermined time period, the electronic time delay assembly electrically actuates the trigger assembly, the trigger assembly mechanically releases the second impact piston and pressure shifts the second impact piston into contact with the initiator.

20 Claims, 7 Drawing Sheets

FIRING HEAD ACTUATOR FOR A WELL PERFORATING SYSTEM AND METHOD FOR USE OF SAME

CROSS-REFERENCE TO RELATED APPLICATIONS

This application claims the benefit under 35 U.S.C. §119 of the filing date of International Application No. PCT/US2013/036528, filed Apr. 15, 2013.

TECHNICAL FIELD OF THE INVENTION

This invention relates, in general, to equipment utilized and operations performed in conjunction with completing a subterranean well for hydrocarbon fluid production and, in particular, to a firing head actuator for a well perforating system and method for operating the firing head actuator.

BACKGROUND OF THE INVENTION

Without limiting the scope of the present invention, its background will be described with reference to perforating a hydrocarbon bearing subterranean formation with a shaped charge perforating gun apparatus, as an example. After drilling a section of a subterranean wellbore that traverses a hydrocarbon bearing subterranean formation, individual lengths of metal tubulars are typically secured together to form a casing string that is positioned within the wellbore. This casing string increases the integrity of the wellbore and provides a path through which fluids from the formation may be produced to the surface. Conventionally, the casing string is cemented within the wellbore. To produce fluids into the casing string or to place addition cement behind the casing string, hydraulic openings or perforations must be made through the casing string and a distance into the formation.

Typically, these perforations are created by detonating a series of shaped charges located within one or more perforating guns that are deployed within the casing string to a position adjacent to the desired location. Conventionally, the perforating guns are formed from a closed, fluid-tight hollow carrier gun body adapted to be lowered into the wellbore on a conveyance such as coiled tubing, a jointed tubing or the like. Disposed within the hollow carrier gun body is a charge holder that supports and positions the shaped charges in a selected spatial distribution. The shaped charges have conically constrained explosive material therein. A detonating cord that is used to detonate the shaped charges is positioned adjacent to the initiation ends of the shaped charges. The detonating cord is typically activated by a firing head when it is desired to initiate the perforating guns.

Many conventional firing heads are operated in response to pressure applied to the firing head from a remote location. For example, many pressure operated firing heads rely on shear pins to select a pressure which, when applied to the firing head, shears the pins and initiates the detonation sequence. With pressure actuated firing heads, the pressure required to trigger actuation must typically be the highest pressure required to trigger actuation of any pressure actuated component in the well. It has been found, however, that the perforation event may require a wellbore pressure that is not consistent with the actuation pressure of the firing head. Depending upon the particular design of the completion, it may be desired to create an underbalanced pressure condition in the wellbore, a balanced pressure condition in the wellbore or a particular overbalanced pressure condition in the wellbore prior to the perforation event. Accordingly, pressure in the wellbore must be reduced after the pressure event that actuates the firing head but before the perforation event.

Efforts have been made to overcome this pressure balance issue using time delay devices, which may be added to a firing head to extend the time period between the pressure event and the perforation event. Convention time delay devices use pyrotechnic time delay fuses that provide delays in the order of minutes. To create a longer delay, more than one pyrotechnic time delay fuse may be added to the firing head. It has been found, however, that in certain installations wherein a time delay in the order of hours is desired, the number of pyrotechnic time delay fuses required the achieve such a time delay and the connections required between the pyrotechnic time delay fuses make these systems unreliable. In addition, the length of a system of pyrotechnic time delay fuses needed to achieve such a time delay makes such a system unfeasible.

A need has therefore arisen for an improved firing head that is operable to provide a time delay between the pressure event and the perforation event. In addition, a need has arisen for such an improved firing head that does not require numerous time delay elements to provide sufficient time for pressure balancing the well prior to the perforation event. Further, a need has arisen for such an improved firing head that does not require time delay elements having an unfeasible length to provide sufficient time for pressure balancing the well prior to the perforation event.

SUMMARY OF THE INVENTION

The present invention disclosed herein comprises a firing head actuator that is operable to provide a time delay between the pressure event and the perforation event. In addition, firing head actuator of the present invention does not require numerous time delay elements to provide sufficient time for pressure balancing the well prior to the perforation event. Further, firing head actuator of the present invention does not require time delay elements having an unfeasible length to provide sufficient time for pressure balancing the well prior to the perforation event.

In one aspect, the present invention is directed to a firing head actuator for a well perforating system. The firing head actuator includes a housing assembly. A first impact piston is initially secured to and slidably disposed within the housing assembly. An electronic time delay assembly is disposed within the housing assembly. A trigger assembly is disposed within the housing assembly. A second impact piston is initially secured within and slidably disposed within the housing assembly. An initiator is disposed within the housing assembly such that a pressure signal of a predetermined threshold actuates the first impact piston, the first impact piston mechanically actuates the electronic time delay assembly, after a predetermined time period, the electronic time delay assembly sends an electric signal to actuate the trigger assembly, the trigger assembly mechanically releases the second impact piston and pressure shifts the second impact piston into contact with the initiator.

In certain embodiments, a plurality of shear pins may initially secure the first impact piston to the housing assembly. In some embodiments, the electronic time delay assembly may include a signal detector, a control circuit, a power supply, an electronic timing device and an output signal generator. In one embodiment, the trigger assembly may include a release piston slidably and sealingly disposed within the housing assembly and selectively moveable between first and second positions. In the first position, the release piston secures the second impact piston within the housing assembly. In the second position, the release piston is remote from the second impact piston. In this embodiment, a barrier is disposed within the housing assembly that selectively separates first and second chambers within the housing assembly such that a fluid may be contained in the first chamber between the barrier and the release piston. The fluid is operable to selectively retain the release piston in the first position. A piercing assembly is disposed within the housing assembly such that, responsive to the electric signal from the electronic time delay assembly, the piercing assembly penetrates the barrier allowing at least a portion of the fluid to flow from the first chamber to the second chamber and allowing pressure to shift the release piston from the first position to the second position. Also, in this embodiment, the piercing assembly may penetrate the barrier responsive to pressure generated by combustion of a chemical element in response to electronic actuation of an ignition agent. In another embodiment, the trigger assembly may include an electric motor disposed within the housing assembly and a release piston operably associated with the electric motor. The release assembly may be slidably disposed within the housing assembly and selectively moveable between first and second positions. In the first position, the release piston secures the second impact piston within the housing assembly. In the second position, the release piston is remote from the second impact piston. In this embodiment, responsive to the electric signal from the electronic time delay assembly, the electric motor retracts the release piston from the first position to the second position. In either of these embodiments, at least one retainer element may be disposed between the release piston and the second impact piston to initially secured the second impact piston within the housing assembly.

In another aspect, the present invention is directed to a well perforating system. The well perforating system includes a tubular string, a perforating gun disposed within the tubular string and a firing head actuator disposed within the tubular string and operably associated with the perforating gun. The firing head actuator includes a housing assembly, a first impact piston initially secured to and slidably disposed within the housing assembly, an electronic time delay assembly disposed within the housing assembly, a trigger assembly disposed within the housing assembly, a second impact piston initially secured within and slidably disposed within the housing assembly and an initiator disposed within the housing assembly, such that a pressure signal of a predetermined threshold actuates the first impact piston, the first impact piston mechanically actuates the electronic time delay assembly, after a predetermined time period, the electronic time delay assembly sends an electric signal to actuate the trigger assembly, the trigger assembly mechanically releases the second impact piston and pressure shifts the second impact piston into contact with the initiator, thereby initiating a detonation event in the perforating gun.

In a further aspect, the present invention is directed to a method for initiating a well perforating system. The method includes providing a firing head actuator including a housing assembly, a first impact piston initially secured to and slidably disposed within the housing assembly, an electronic time delay assembly disposed within the housing assembly, a trigger assembly disposed within the housing assembly, a second impact piston initially secured within and slidably disposed within the housing assembly and an initiator disposed within the housing assembly; operably associating the firing head actuator with a perforating gun disposed within a tubular string; positioning the firing head actuator and the perforating gun at a target location in a well; generating a pressure signal of a predetermined threshold to actuate the first impact piston; mechanically actuating the electronic time delay assembly with first impact piston; after a predetermined time period, sending an electric signal from the electronic time delay assembly to actuate the trigger assembly; mechanically releasing the second impact piston with the trigger assembly; responsive to pressure, shifting the second impact piston into contact with the initiator; and initiating a detonation event in the perforating gun.

The method may also include penetrating a barrier with a piecing assembly; flowing fluid from a first chamber to a second chamber within the housing assembly through the barrier; responsive to pressure, shifting a release piston from a first position, wherein the release piston secures the second impact piston within the housing assembly, to a second position, wherein the release piston is remote from the second impact piston; generating pressure by combustion of a chemical element responsive to electronic actuation of an ignition agent by the electric signal from the electronic time delay assembly and/or retracting a release piston from a first position, wherein the release piston secures the second impact piston within the housing assembly, to a second position, wherein the release piston is remote from the second impact piston with an electric motor.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
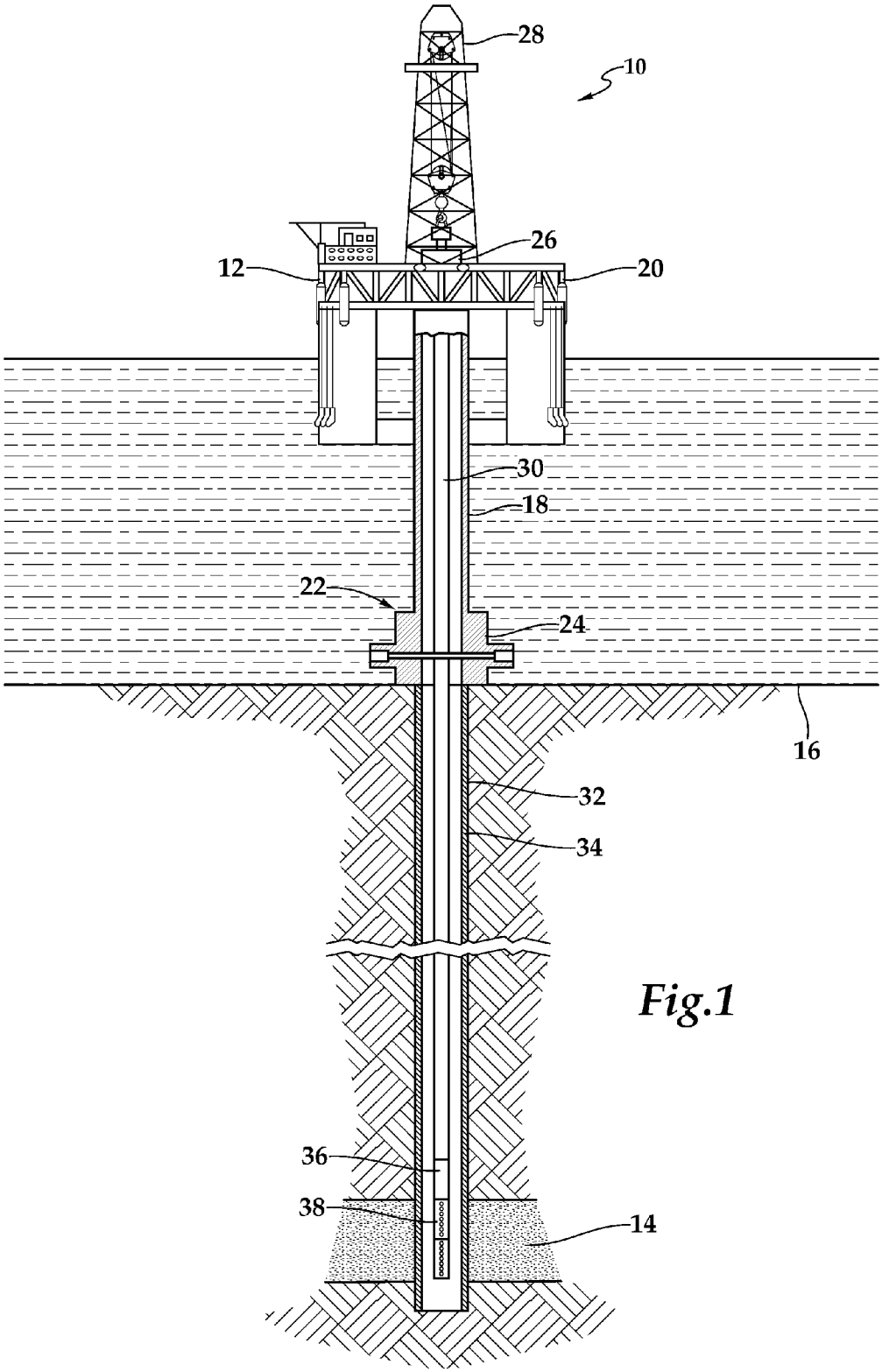
FIG. 1 is a schematic illustration of an offshore oil and gas platform operating a well perforating system according to an embodiment of the present invention.

Referring initially to FIG. 1, a well perforating system being operated from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as a work string 30.

A wellbore 32 extends through the various earth strata including formation 14. A casing 34 is secured within wellbore 32. Work string 30 includes various tools such as a firing head actuator 36 and a shaped charge perforating gun apparatus tandem 38. When it is desired to perforate wellbore 32 proximate formation 14, work string 30 is lowered through casing 34 until perforating gun tandem 38 is positioned adjacent to formation 14, as illustrated. Thereafter, a pressure signal is sent from the surface to firing head actuator 36 via wellbore 32 and/or work string 30, such as by increasing the pressure in a compressible or substantially incompressible fluid. When the pressure signal reaches a predetermined threshold, the actuation sequence commences by breaking one or more shear pins within firing head actuator 36. This mechanical response to the pressure event by firing head actuator 36 triggers an electronic timer mechanism within firing head actuator 36 that delays further response by firing head actuator 36 such that the desired pressure balance may be established in wellbore 32 prior to the perforation event. When the electronic timer mechanism times out, an electronic signal is sent to a trigger mechanism of firing head actuator 36, which causes a pressure actuated impact piston to be mechanically released. The pressure actuated impact piston then contacts an initiator that starts the detonation sequence causing shaped charges within perforating gun tandem 38 to form high speed jets that penetrate casing 34 and a depth into formation 14 forming perforations therein.

Even though FIG. 1 depicts the present invention in a vertical wellbore, it should be understood by those skilled in the art that the present invention is equally well suited for use in wellbores having other directional configurations including horizontal wellbores, deviated wellbores, slanted wellbores, lateral wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts the present invention in an offshore operation, it should be understood by those skilled in the art that the present invention is equally well suited for use in onshore operations.

Figure 2A:
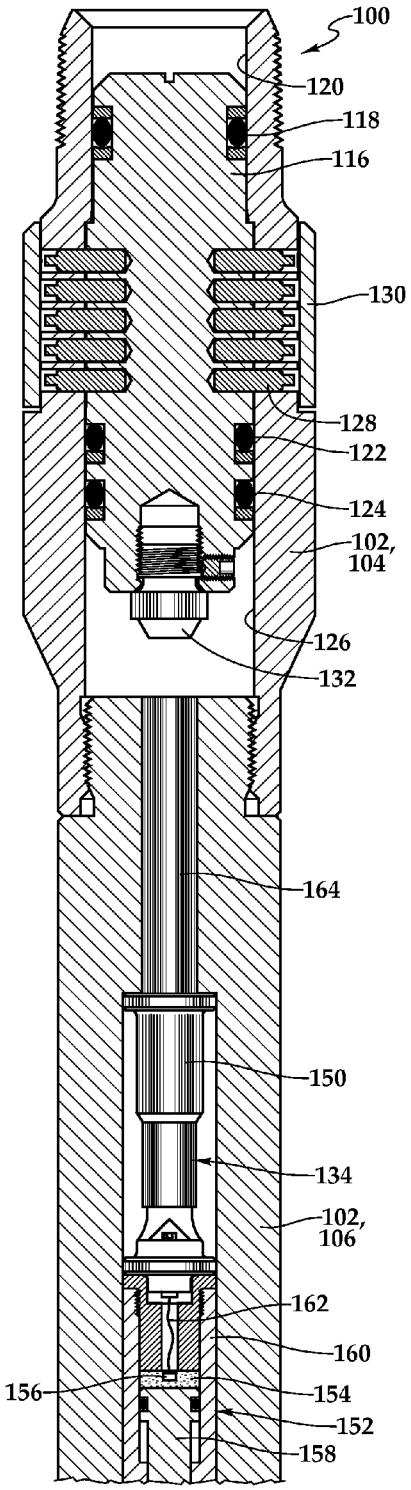
FIGS. 2A-2C are partial cross sectional views of consecutive axial sections of a firing head actuator for use in a well perforating system according to an embodiment of the present invention prior to actuation.
Figure 2B:
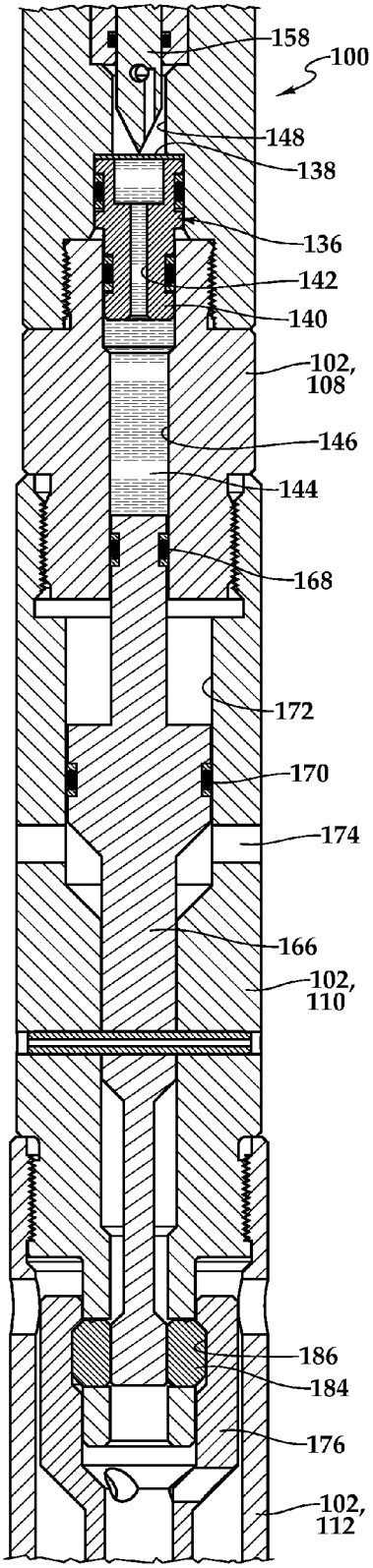
Figure 2C:
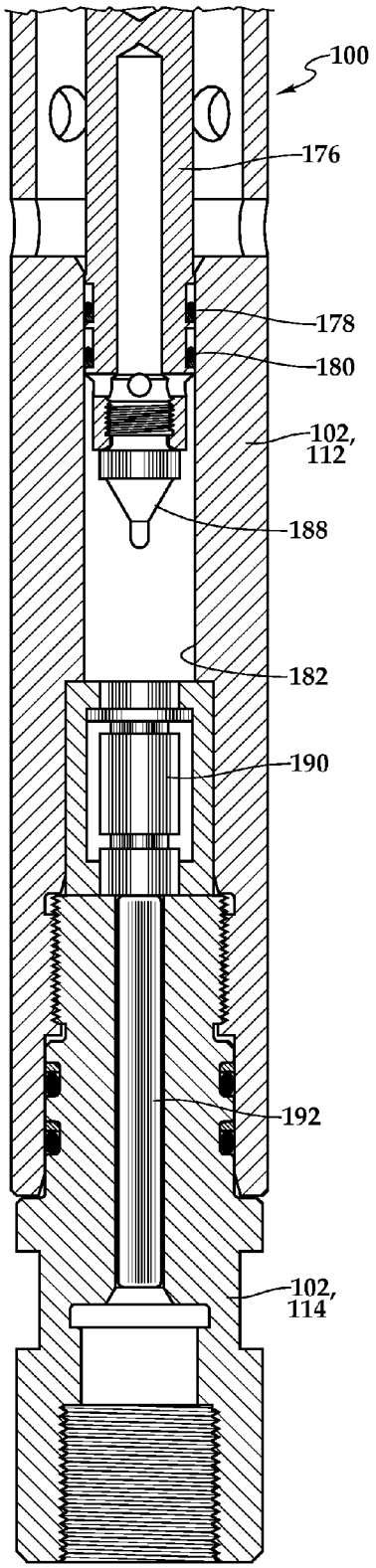

Referring now to FIGS. 2A-2C, a firing head actuator for a well perforating system is depicted and generally designated 100. The firing head actuator 100 includes an actuator housing assembly 102 that is operable to be coupled within a tubular string as described above. In the illustrated embodiment, actuator housing assembly 102 includes a upper impact piston housing member 104, timer housing member 106 that is threadably coupled to the lower end of upper impact piston housing member 104, a fluid chamber housing member 108 that is threadably coupled to the lower end of timer housing member 106, a release piston housing member 110 that is threadably coupled to the lower end of fluid chamber housing member 108, a lower impact piston housing member 112 that is threadably coupled to the lower end of release piston housing member 110 and an end cap housing member 114 that is threadably coupled to the lower end of lower impact piston housing member 112. Even though actuator housing assembly 102 has been depicted and described as having a particular number and a particular arrangement of housing member, those skilled in the art will recognize that an actuator housing assembly could alternatively have a different arrangement of a different number of housing members without departing from the principles of the present invention.

An upper impact piston 116 is disposed within upper impact piston housing member 104. Upper impact piston 116 has an outer O-ring 118 that seals within an upper bore 120 of upper impact piston housing member 104. Upper impact piston 116 also has outer O-rings 122, 124 that seal within a lower bore 126 of upper impact piston housing member 104. Upper impact piston 116 is initially secured to upper impact piston housing member 104 by a plurality of shear pins 128. A pin retainer sleeve 130 is disposed about upper impact piston housing member 104. Upper impact piston 116 carries a actuation pin 132 on its lower end.

A time delay actuation assembly 134 is disposed within timer housing member 106. Time delay actuation assembly 134 includes a barrier assembly 136 that includes a barrier 138 and a support assembly 140 having a fluid passageway 142 defined therethrough. Barrier 138 initially prevents fluid 144 disposed within chamber 146 of fluid chamber housing member 108 from entering a chamber 148 of timer housing member 106. Time delay actuation assembly 134 also includes an electronic time delay assembly depicted as control system 150 that includes a signal detector, a control circuit, a power supply, an electronic timing device and an electric signal output generator. Time delay actuation assembly 134 further includes a piercing assembly 152 includes a chemical element or energetic material 154, an ignition agent 156 and a piercing element 158 slidably disposed within a cylinder 160. Chemical element 154 is preferably a combustible element such as a propellant that has the capacity for extremely rapid but controlled combustion that produces a combustion event including the production of a large volume of gas at high temperature and pressure.

In an exemplary embodiment, chemical element 154 may comprises a solid propellant such as nitrocellulose plasticized with nitroglycerin or various phthalates and inorganic salts suspended in a plastic or synthetic rubber and containing a finely divided metal. Chemical element 154 may comprise inorganic oxidizers such as ammonium and potassium nitrates and perchlorates such as potassium perchlorate. It should be appreciated, however, that substances other than propellants may be utilized without departing from the principles of the present invention, including other explosives, pyrotechnics, flammable solids or the like. In the illustrated embodiment, ignition agent 156 is connected to the control circuit via an electrical cable 162 so that, when the predetermined time period of the electronic timing device has expired, the control circuit supplies an electric signal in the form of an electrical current to ignition agent 156. In the illustrated embodiment, the signal detector of control system 150 is operably associated with a sensor depicted as percussion element 164.

At its lower end, time delay actuation assembly 134 includes a release piston 166 is partially is disposed within release piston housing member 110. Release piston 166 has an outer O-ring 168 that seals within chamber 146 of fluid chamber housing member 108. Release piston 166 also has outer an O-ring 170 that seals within bore 172 of release piston housing member 110. Release piston housing member 110 has one or more ports 174 that provide fluid communication between the wellbore and a lower piston area of release piston 166. Together, release piston 166, barrier assembly 136 and piercing assembly 152 may be referred to as a trigger assembly.

A lower impact piston 176 is disposed within lower impact piston housing member 112. Lower impact piston 176 has outer O-rings 178, 180 that seal within a bore 182 of lower impact piston housing member 112. Lower impact piston 176 is initially secured within lower impact piston housing member 112 by the interaction of release piston 166 supporting retainer elements 184 within detents or a radial groove 186 of lower impact piston 176. Lower impact piston 176 carries a firing pin 188 on its lower end. A percussion type initiator 190 is disposed between lower impact piston housing member 112 and end cap housing member 114. An upper portion of a detonation cord 192 is disposed within end cap housing member 114. Detonation cord 192 is the first element of the detonation train the initiates shaped charges within the perforating guns operably associated with firing head actuator 100.

Figure 3A:
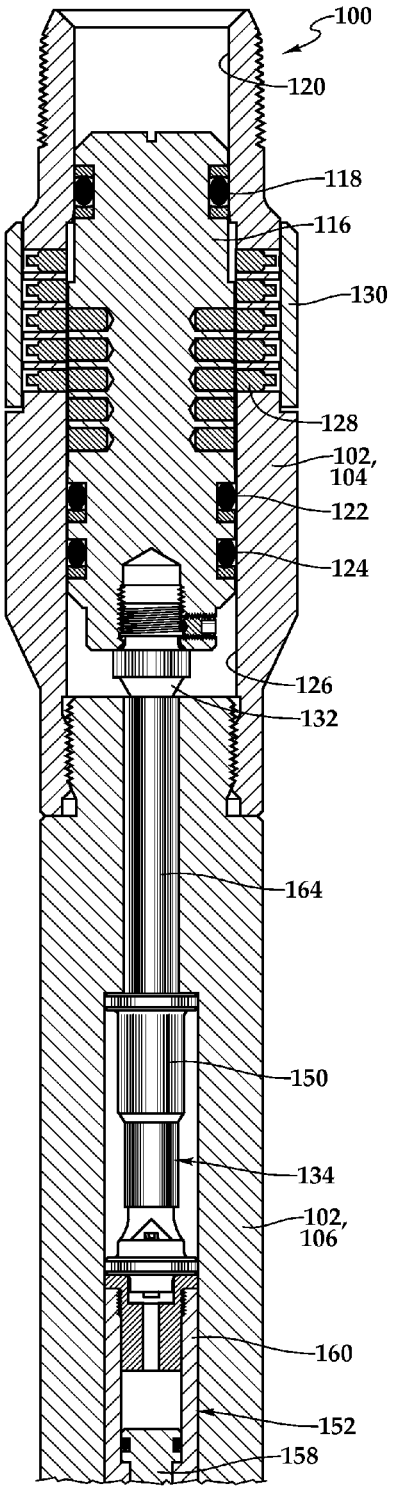
FIGS. 3A-3C are partial cross sectional views of consecutive axial sections of a firing head actuator for use in a well perforating system according to an embodiment of the present invention after actuation.

The operation of firing head actuator 100 will now be described with reference to FIGS. 2A-2C and 3A-3C. When it is desired to perforate the wellbore, a pressure signal is sent from the surface to firing head actuator 100 via the wellbore and the work string conveying the well perforating system as described above. For example, this may be achieved by increasing the pressure in a compressible or substantially incompressible fluid in the wellbore that is communicated to firing head actuator 100 via one or more ports in the work string. This pressure signal is applied to an upper piston area of upper impact piston 116. When the pressure signal reaches a predetermined threshold, the downward force on upper impact piston 116 causes shear pins 128 to break. This allows upper impact piston 116 to move downwardly relative to upper impact piston housing member 104 and causes actuation pin 132 to contact sensor 164, as best seen in FIG. 3A. The mechanical interaction or contact between actuation pin 132 and sensor 164 provides an input signal to the signal detector of control system 150. The control circuit of control system 150 processes the input signal and starts a clock within the electronic timing device of control system 150. The well operator may now pressure balance the well as desired by bleeding off the required amount of pressure.

Figure 3B:
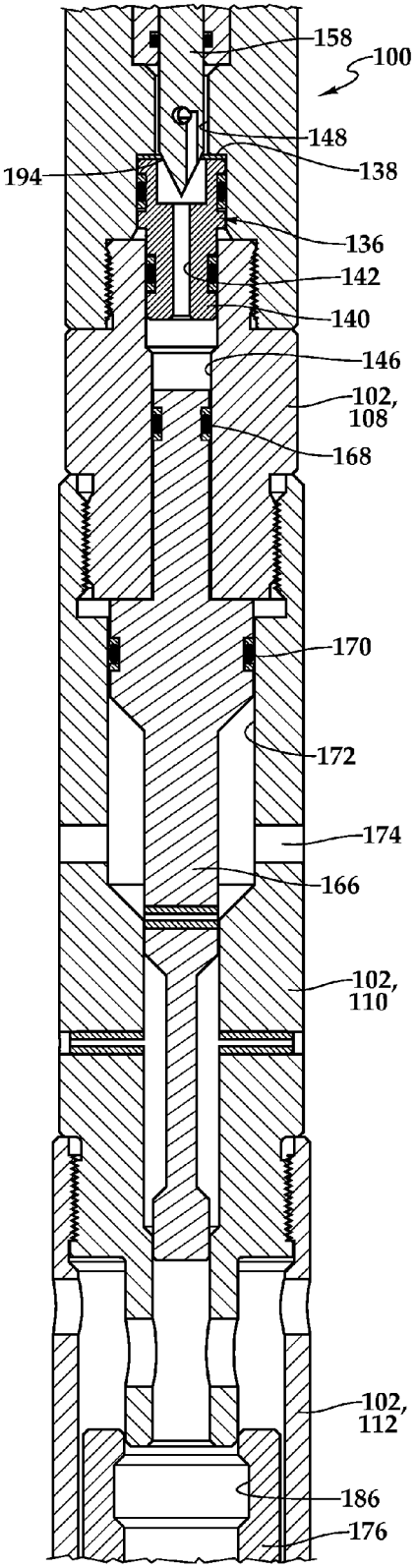
Figure 3C:
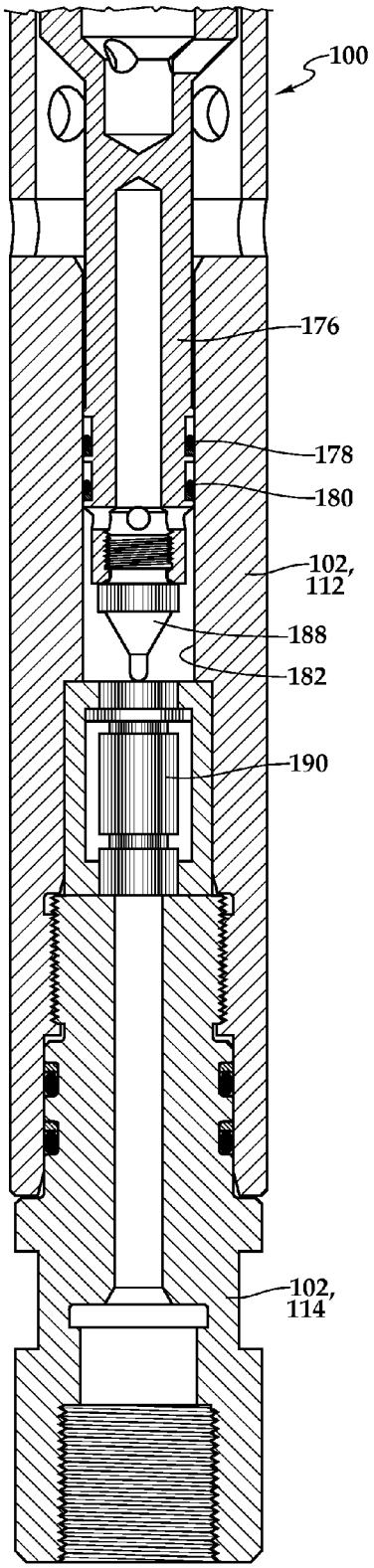

When the predetermined time period of the electronic timing device has elapsed, a clock output signal is processed by the control circuit. The control circuit then causes an electric signal, for example, an electrical current, to be supplied from the power supply to ignition agent 156. Ignition agent 156 now initiates a chemical reaction in chemical element 154. The chemical reaction creates pressure that acts on piercing element 158 causing downward movement of piecing barrier 138, as best seen in FIG. 3B. Fluid communication is thus established between chamber 146 and chamber 148 through opening 194 in barrier 138, which allows fluid 144 to exit chamber 146 as release piston 166 is urged upwardly by pressure from the wellbore via ports 174. The upward movement of release piston 166 releases retainer elements 184 from radial groove 186 of lower impact piston 176, as best seen in FIG. 3B. Wellbore pressure acting on lower impact piston 176 now urges lower impact piston 176 downwardly. The downward movement causes firing pin 188 to impact percussion initiator 190, as best seen in FIG. 3C. This impact starts the progression of the detonation event at detonation cord 192, which continues through the perforating guns as discussed above.

Figure 4A:
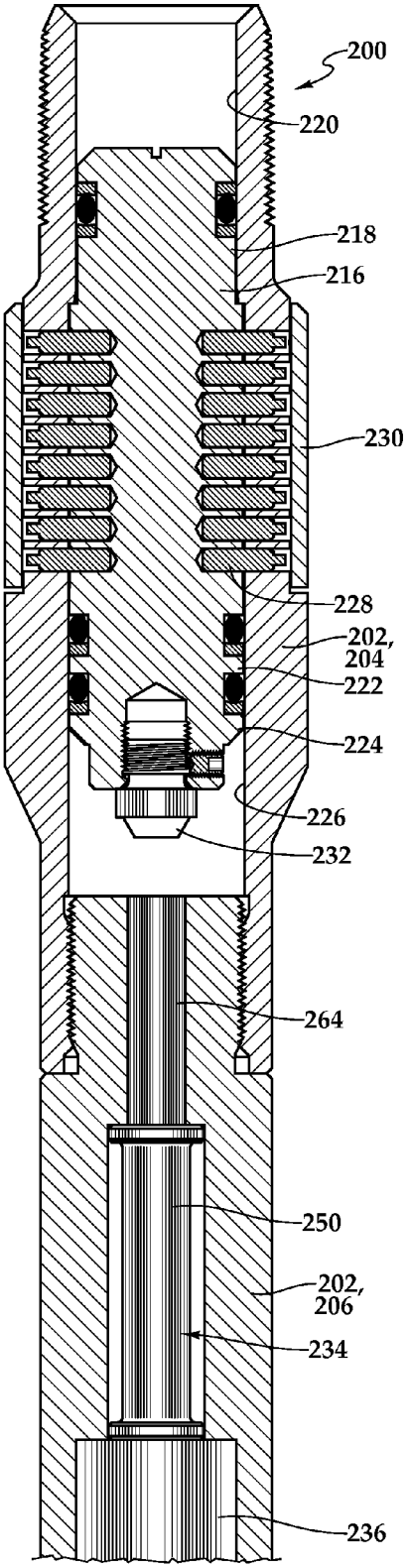
FIGS. 4A-4C are partial cross sectional views of consecutive axial sections of a firing head actuator for use in a well perforating system according to an embodiment of the present invention prior to actuation.
Figure 4B:
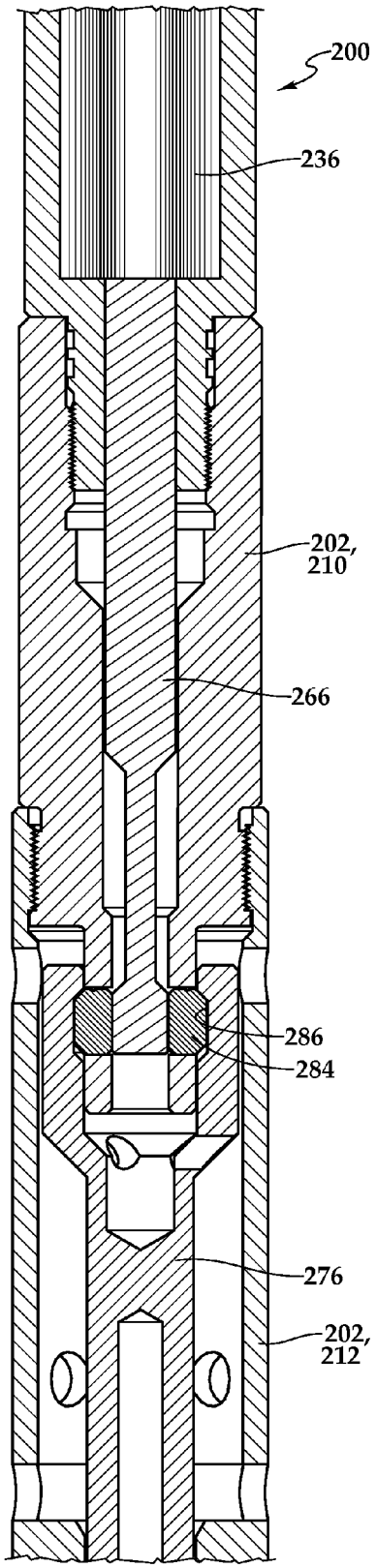
Figure 4C:
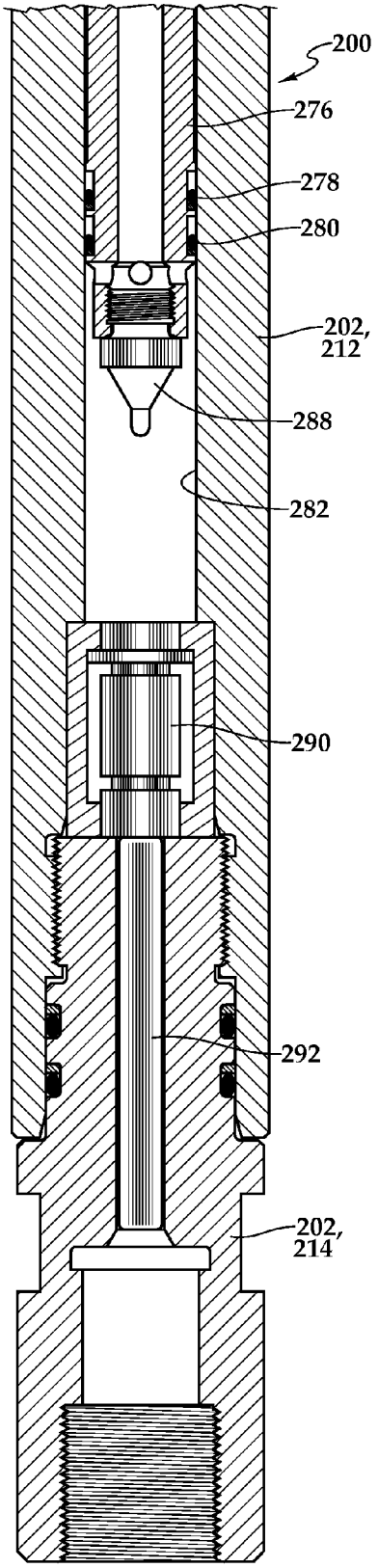

Referring next to FIGS. 4A-4C, a firing head actuator for a well perforating system is depicted and generally designated 200. The firing head actuator 200 includes an actuator housing assembly 202 that is operable to be coupled within a tubular string as described above. In the illustrated embodiment, actuator housing assembly 202 includes a upper impact piston housing member 204, timer housing member 206 that is threadably coupled to the lower end of upper impact piston housing member 204, a release piston housing member 210 that is threadably coupled to the lower end of timer housing member 206, a lower impact piston housing member 212 that is threadably coupled to the lower end of release piston housing member 210 and an end cap housing member 214 that is threadably coupled to the lower end of lower impact piston housing member 212. Even though actuator housing assembly 202 has been depicted and described as having a particular number and a particular arrangement of housing member, those skilled in the art will recognize that an actuator housing assembly could alternatively have a different arrangement of a different number of housing members without departing from the principles of the present invention.

An upper impact piston 216 is disposed within upper impact piston housing member 204. Upper impact piston 216 has an outer O-ring 218 that seals within an upper bore 220 of upper impact piston housing member 204. Upper impact piston 216 also has outer O-rings 222, 224 that seal within a lower bore 226 of upper impact piston housing member 204. Upper impact piston 216 is initially secured to upper impact piston housing member 204 by a plurality of shear pins 228. A pin retainer sleeve 230 is disposed about upper impact piston housing member 204. Upper impact piston 216 carries a actuation pin 232 on its lower end.

A time delay actuation assembly 234 is disposed within timer housing member 206. Time delay actuation assembly 234 includes an electric motor 236. Time delay actuation assembly 234 also includes an electronic time delay assembly depicted as a control system 250 that includes a signal detector, a control circuit, a power supply, an electronic timing device and an output signal generator. In the illustrated embodiment, the signal detector of control system 250 is operably associated with a sensor depicted as percussion element 264. Time delay actuation assembly 234 also includes a release piston 266 that is partially disposed within release piston housing member 210 and has an upper end that is coupled to and received within electric motor 236. Together, release piston 266 and electric motor 236 may be referred to as a trigger assembly. A lower impact piston 276 is disposed within lower impact piston housing member 212. Lower impact piston 276 has outer O-rings 278, 280 that seal within a bore 282 of lower impact piston housing member 212. Lower impact piston 276 is initially secured to lower impact piston housing member 212 by the interaction of release piston 266 supporting retainer elements 284 within detents or a radial groove 286 of lower impact piston 276. Lower impact piston 276 carries a firing pin 288 on its lower end. A percussion type initiator 290 is disposed between lower impact piston housing member 212 and end cap housing member 214. An upper portion of a detonation cord 292 is disposed within end cap housing member 214. Detonation cord 292 is the first element of the detonation train that initiates shaped charges within the perforating guns operably associated with firing head actuator 200.

Figure 5A:
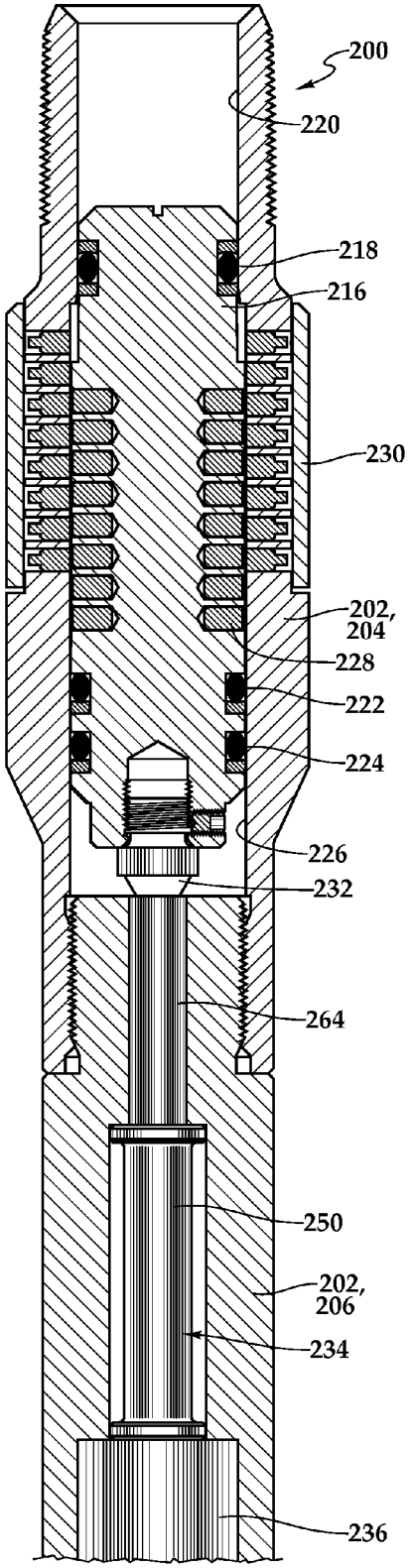
FIGS. 5A-5C are partial cross sectional views of consecutive axial sections of a firing head actuator for use in a well perforating system according to an embodiment of the present invention after actuation.
Figure 5B:
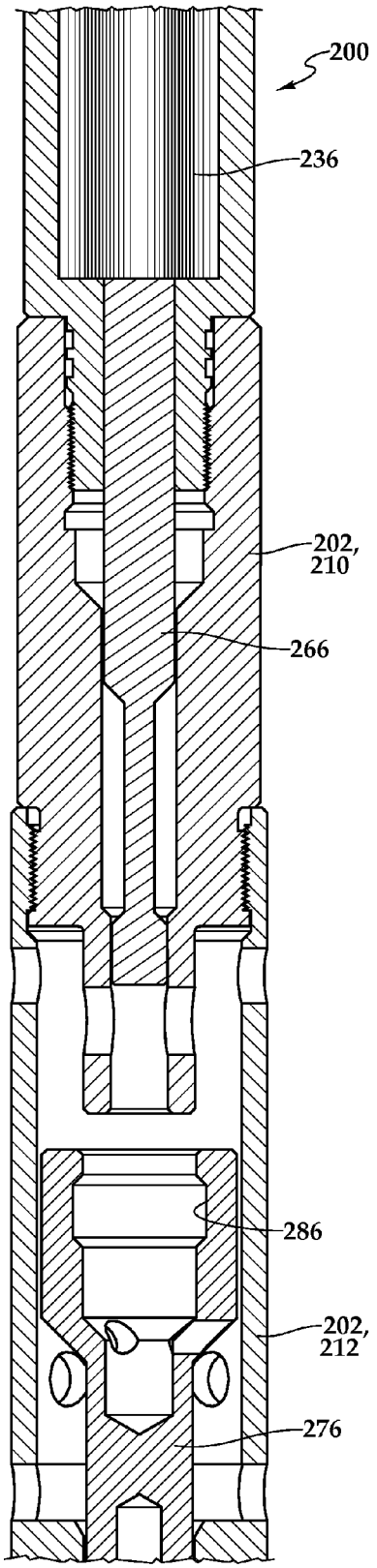
Figure 5C:
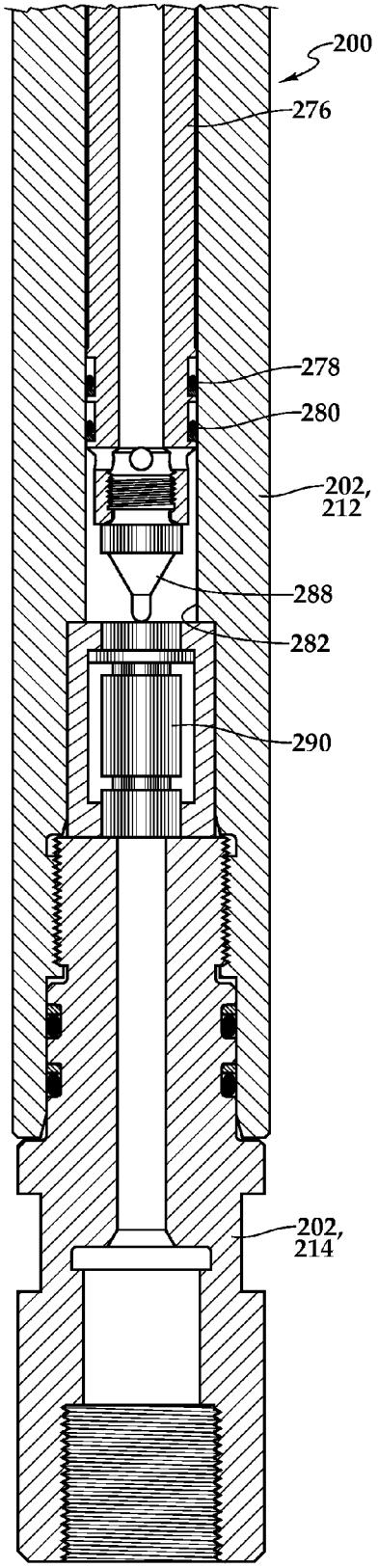

The operation of firing head actuator 200 will now be described with reference to FIGS. 4A-4C and 5A-5C. When it is desired to perforate the wellbore, a pressure signal is sent from the surface to firing head actuator 200 via the wellbore and the work string conveying the well perforating system as described above. The pressure signal is applied to an upper piston area of upper impact piston 216. When the pressure signal reaches a predetermined threshold, the downward force on upper impact piston 216 causes shear pins 228 to break. This allows upper impact piston 216 to move downwardly relative to upper impact piston housing member 204 and causes actuation pin 232 to contact sensor 264, as best seen in FIG. 5A. The mechanical interaction or contact between actuation pin 232 and sensor 264 provides an input signal to the signal detector of control system 250. The control circuit of control system 250 processes the input signal and starts a clock within the electronic timing device of control system 250. The well operator may now pressure balance the well as desired by bleeding off the required amount of pressure. When the predetermined time period of the electronic timing device has elapsed, a clock output signal is processed by the control circuit. The control circuit then causes an electric signal, for example, an electrical voltage, to be supplied from the power supply to electric motor 236. Operation of electric motor 236 retracts release piston 266 in the upward direction. The upward movement of release piston 266 releases retainer elements 284 from radial groove 286 of lower impact piston 276, as best seen in FIG. 5B. Wellbore pressure acting on lower impact piston 276 now urges lower impact piston 276 downwardly. The downward movement causes firing pin 288 to impact percussion initiator 290, as best seen in FIG. 5C. This impact starts the progression of the detonation event at detonation cord 292, which continues through the perforating guns as discussed above.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A firing head actuator for a well perforating system comprising:

a housing assembly;

a first impact piston initially secured to and slidably disposed within the housing assembly;

an electronic time delay assembly disposed within the housing assembly;

a trigger assembly disposed within the housing assembly;

a second impact piston initially secured within and slidably disposed within the housing assembly; and an initiator disposed within the housing assembly, wherein, a pressure signal of a predetermined threshold actuates the first impact piston;

wherein, the first impact piston mechanically actuates the electronic time delay assembly;

wherein, after a predetermined time period, the electronic time delay assembly sends an electric signal to actuate the trigger assembly;

wherein, the trigger assembly mechanically releases the second impact piston; and wherein, pressure shifts the second impact piston into contact with the initiator.

2. The firing head actuator as recited in claim 1 further comprising a plurality of shear pins that initially secured the first impact piston to the housing assembly.

3. The firing head actuator as recited in claim 1 wherein the electronic time delay assembly further comprises a signal detector, a control circuit, a power supply, an electronic timing device and an output signal generator.

4. The firing head actuator as recited in claim 1 wherein the trigger assembly further comprises:

a release piston slidably and sealingly disposed within the housing assembly and selectively moveable between first and second positions, in the first position, the release piston securing the second impact piston within the housing assembly, in the second position, the release piston remote from the second impact piston;

a barrier disposed within the housing assembly and selectively separating first and second chambers within the housing assembly;

a fluid disposed in the first chamber between the barrier and the release piston, the fluid operable to selectively retain the release piston in the first position; and a piercing assembly disposed within the housing assembly, wherein, responsive to the electric signal from the electronic time delay assembly, the piercing assembly penetrates the barrier such that at least a portion of the fluid flows from the first chamber to the second chamber and such that pressure shift the release piston from the first position to the second position.

5. The firing head actuator as recited in claim 4 wherein the piercing assembly penetrates the barrier responsive to pressure generated by combustion of a chemical element responsive to electronic actuation of an ignition agent.

6. The firing head actuator as recited in claim 4 further comprising at least one retainer element disposed between the release piston and the second impact piston to initially secure the second impact piston within the housing assembly.

7. The firing head actuator as recited in claim 1 wherein the trigger assembly further comprises:

a release piston slidably disposed within the housing assembly and selectively moveable between first and second positions, in the first position, the release piston securing the second impact piston within the housing assembly, in the second position, the release piston remote from the second impact piston; and an electric motor disposed within the housing assembly and operably associated with the release piston, wherein, responsive to the electric signal from the electronic time delay assembly, the electric motor retracts the release piston from the first position to the second position.

8. The firing head actuator as recited in claim 7 further comprising at least one retainer element disposed between the release piston and the second impact piston to initially secure the second impact piston within the housing assembly.

9. A well perforating system comprising:

a tubular string;

a perforating gun disposed within the tubular string; and a firing head actuator disposed within the tubular string and operably associated with the perforating gun, the firing head actuator including a housing assembly, a first impact piston initially secured to and slidably disposed within the housing assembly, an electronic time delay assembly disposed within the housing assembly, a trigger assembly disposed within the housing assembly, a second impact piston initially secured within and slidably disposed within the housing assembly and an initiator disposed within the housing assembly, wherein, a pressure signal of a predetermined threshold actuates the first impact piston;

wherein, the first impact piston mechanically actuates the electronic time delay assembly;

wherein, after a predetermined time period, the electronic time delay assembly sends an electric signal to actuate the trigger assembly;

wherein, the trigger assembly mechanically releases the second impact piston; and wherein, pressure shifts the second impact piston into contact with the initiator, thereby initiating a detonation event in the perforating gun.

10. The well perforating system as recited in claim 9 wherein the firing head actuator further comprises a plurality of shear pins that initially secured the first impact piston to the housing assembly.

11. The well perforating system as recited in claim 9 wherein the electronic time delay assembly further comprises a signal detector, a control circuit, a power supply, an electronic timing device and an output signal generator.

12. The well perforating system as recited in claim 9 wherein the trigger assembly further comprises:

a release piston slidably and sealingly disposed within the housing assembly and selectively moveable between first and second positions, in the first position, the release piston securing the second impact piston within the housing assembly, in the second position, the release piston remote from the second impact piston;

a barrier disposed within the housing assembly and selectively separating first and second chambers within the housing assembly;

a fluid disposed in the first chamber between the barrier and the release piston, the fluid operable to selectively retain the release piston in the first position; and a piercing assembly disposed within the housing assembly, wherein, responsive to the electric signal from the electronic time delay assembly, the piercing assembly penetrates the barrier such that at least a portion of the fluid flows from the first chamber to the second chamber and such that pressure shift the release piston from the first position to the second position.

13. The well perforating system as recited in claim 12 wherein the piercing assembly penetrates the barrier responsive to pressure generated by combustion of a chemical element responsive to electronic actuation of an ignition agent.

14. The well perforating system as recited in claim 12 wherein the firing head actuator further comprises at least one retainer element disposed between the release piston and the second impact piston to initially secure the second impact piston within the housing assembly.

15. The well perforating system as recited in claim 9 wherein the trigger assembly further comprises:

a release piston slidably disposed within the housing assembly and selectively moveable between first and second positions, in the first position, the release piston securing the second impact piston within the housing assembly, in the second position, the release piston remote from the second impact piston; and an electric motor disposed within the housing assembly and operably associated with the release piston, wherein, responsive to the electric signal from the electronic time delay assembly, the electric motor retracts the release piston from the first position to the second position.

16. The well perforating system as recited in claim 15 wherein the firing head actuator further comprises at least one retainer element disposed between the release piston and the second impact piston to initially secure the second impact piston within the housing assembly.

17. A method for initiating a well perforating system comprising:

providing a firing head actuator including a housing assembly, a first impact piston initially secured to and slidably disposed within the housing assembly, an electronic time delay assembly disposed within the housing assembly, a trigger assembly disposed within the housing assembly, a second impact piston initially secured within and slidably disposed within the housing assembly and an initiator disposed within the housing assembly;

operably associating the firing head actuator with a perforating gun disposed within a tubular string;

positioning the firing head actuator and the perforating gun at a target location in a well;

generating a pressure signal of a predetermined threshold to actuate the first impact piston;

mechanically actuating the electronic time delay assembly with first impact piston;

after a predetermined time period, sending an electric signal from the electronic time delay assembly to actuate the trigger assembly;

mechanically releasing the second impact piston with the trigger assembly;

responsive to pressure, shifting the second impact piston into contact with the initiator; and initiating a detonation event in the perforating gun.

18. The method as recited in claim 17 wherein actuating the trigger assembly further comprises:

penetrating a barrier with a piecing assembly;

flowing fluid from a first chamber to a second chamber within the housing assembly through the barrier; and responsive to pressure, shifting a release piston from a first position wherein the release piston secures the second impact piston within the housing assembly to a second position wherein the release piston is remote from the second impact piston.

19. The method as recited in claim 18 wherein penetrating the barrier with the piecing assembly further comprises generating pressure by combustion of a chemical element responsive to electronic actuation of an ignition agent by the electric signal from the electronic time delay assembly.

20. The method as recited in claim 17 wherein actuating the trigger assembly further comprises retracting a release piston from a first position wherein the release piston secures the second impact piston within the housing assembly to a second position wherein the release piston is remote from the second impact piston with an electric motor.

* * * * *